US007089831B2

(12) United States Patent
Chen

(10) Patent No.: US 7,089,831 B2
(45) Date of Patent: Aug. 15, 2006

(54) CROSS-TYPE WRENCH

(76) Inventor: Chia Huan Chen, No. 372, Pengyi Rd., Taiping City, Taichung County 411 (TW)

( * ) Notice: Subject to any disclaimer, the term of this patent is extended or adjusted under 35 U.S.C. 154(b) by 67 days.

(21) Appl. No.: 11/002,311

(22) Filed: Dec. 3, 2004

(65) Prior Publication Data

US 2006/0117914 A1 Jun. 8, 2006

(51) Int. Cl.
*B25B 13/06* (2006.01)

(52) U.S. Cl. ..... 81/124.4; 81/177.2

(58) Field of Classification Search ..... 81/124.4, 81/124.5, 124.7, 177.5, 177.2, 177.85; 403/85, 403/174–175, 217–219
See application file for complete search history.

(56) References Cited

U.S. PATENT DOCUMENTS 6,257,103 B1 * 7/2001 Yu ..... 81/177.6
6,345,554 B1 * 2/2002 Wang ..... 81/124.4
6,692,178 B1 * 2/2004 Yu ..... 403/85

* cited by examiner

*Primary Examiner*—Debra S Meislin
(74) *Attorney, Agent, or Firm*—Rosenberg, Klein & Lee

(57) ABSTRACT

A cross-type wrench including a connector in which a dogging cavity and a receiving space are formed and an adjustment member accommodated in the dogging cavity and the receiving space. The adjustment member has a downward extending engaging section formed with multiple fixing holes. A press button is disposed on top end of the adjustment member. The press button is connected with a downward extending shaft rod formed with an axial shaft hole. A second fixing member is passed through a bottom end of the connector and inserted in the shaft hole. A resilient member is fitted around the shaft rod. The outer circumference of the connector is formed with multiple fixing tunnels for several rotary members to insert therein.

4 Claims, 6 Drawing Sheets

CROSS-TYPE WRENCH

BACKGROUND OF THE INVENTION

The present invention is related to a cross-type wrench which can multidirectionally wrench a work piece and can be easily assembled/disassembled.

FIGS. 5 and 6 show a conventional cross-type wrench having a connector 6. The connector 6 is formed with an axial recess 61 having a first threaded section 611. An adjustment member 7 having a second threaded section 71 can be screwed into the recess 61. Several through holes 62 are radially formed on the connector 6 at equal intervals. Several rotary members 8 can be inserted in the through holes 62. The adjustment member 7 can be screwed for fixing the rotary members 8 to form the cross-type wrench for wrenching a work piece.

In the above structure, the connector 6 and the adjustment member 7 are connected by means of the first and second threaded sections 611, 71. Accordingly, after the adjustment member 7 and the connector 6 are produced, it is necessary to additionally process the adjustment member 7 and the connector 6 to form the threaded sections. Such operation is time-consuming and laborious so that the manufacturing cost is higher.

Moreover, in a working site, it is necessary to frequently replace the rotary member 8 according to the size of the wrenched work piece. When replacing the rotary member 8, it is necessary to first screw the adjustment member 7 to a certain position. Such procedure is time-consuming and laborious. Therefore, the working efficiency will be affected.

Furthermore, the connector 6 and the adjustment member 7 are connected by means of the first and second threaded sections 611, 71. After a period of use, the threads will be worn out. This will lead to slippage between the first and second threaded sections 611, 71.

SUMMARY OF THE INVENTION

It is therefore a primary object of the present invention to provide a cross-type wrench including a connector in which a dogging cavity and a receiving space are formed and an adjustment member accommodated in the dogging cavity and the receiving space. A resilient member is fitted around a shaft rod of the adjustment member. The shaft rod with the resilient member is mounted in the dogging cavity of the connector. A second fixing member is inserted in the shaft rod, whereby by means of the restoring force of the resilient member, the adjustment member can be moved relative to the connector for more quickly replacing the rotary members.

It is a further object of the present invention to provide the above cross-type wrench in which the adjustment member and the connector are both integrally made without secondary processing. Therefore, the time and labor are saved and the manufacturing cost is lowered.

According to the above objects, the cross-type wrench of the present invention includes a connector in which a dogging cavity and a receiving space are formed and an adjustment member accommodated in the dogging cavity and the receiving space. The adjustment member has a downward extending engaging section formed with multiple fixing holes. A press button is disposed on top end of the adjustment member. The press button is connected with a downward extending shaft rod formed with an axial shaft hole. A second fixing member is passed through a bottom end of the connector and inserted in the shaft hole. A resilient member is fitted around the shaft rod. The outer circumference of the connector is formed with multiple fixing tunnels for several rotary members to insert therein.

The present invention can be best understood through the following description and accompanying drawings wherein:

DETAILED DESCRIPTION OF THE PREFERRED EMBODIMENTS

Figure 1:
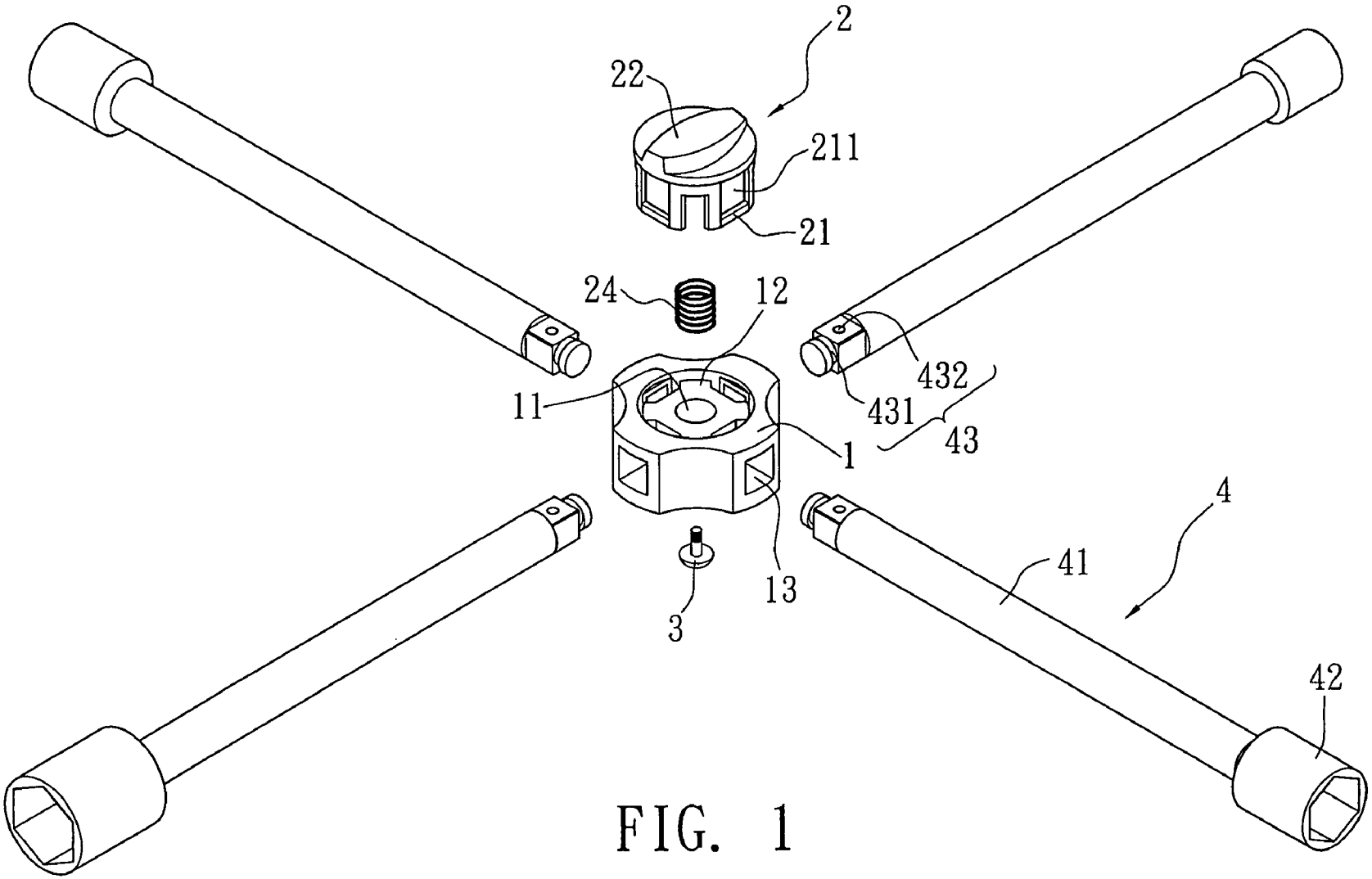
FIG. 1 is a perspective exploded view of the present invention.

Please refer to FIG. 1. The cross-type wrench of the present invention includes a connector 1 in which a dogging cavity 11 and a receiving space 12 are formed. The cross-type wrench further includes an adjustment member 2 accommodated in the dogging cavity 11 and the receiving space 12. The adjustment member 2 has a downward extending engaging section 21 formed with multiple fixing holes 211. A press button 22 is disposed on a top end of the adjustment member 2. The press button 22 is connected with a downward extending shaft rod 23 formed with an axial shaft hole 231. A second fixing member 3 is passed through the bottom of the connector 1 and inserted in the shaft hole 231. In this embodiment, the second fixing member 3 is a rivet with an embossed top end. A resilient member 24 is fitted around the shaft rod 23. The outer circumference of the connector 1 is formed with multiple fixing tunnels 13. In this embodiment, the fixing tunnels 13 extend from the outer circumference of the connector 1 into the receiving space 12 corresponding to the fixing holes 211. Several rotary members 4 are inserted through the fixing tunnels 13 into the fixing holes 211. In this embodiment, each rotary member 4 includes a handle section 41, a wrenching section 42 and a fixing section 43. The fixing section 43 has an engaging channel 431 and a fixing member 432.

Figure 2:
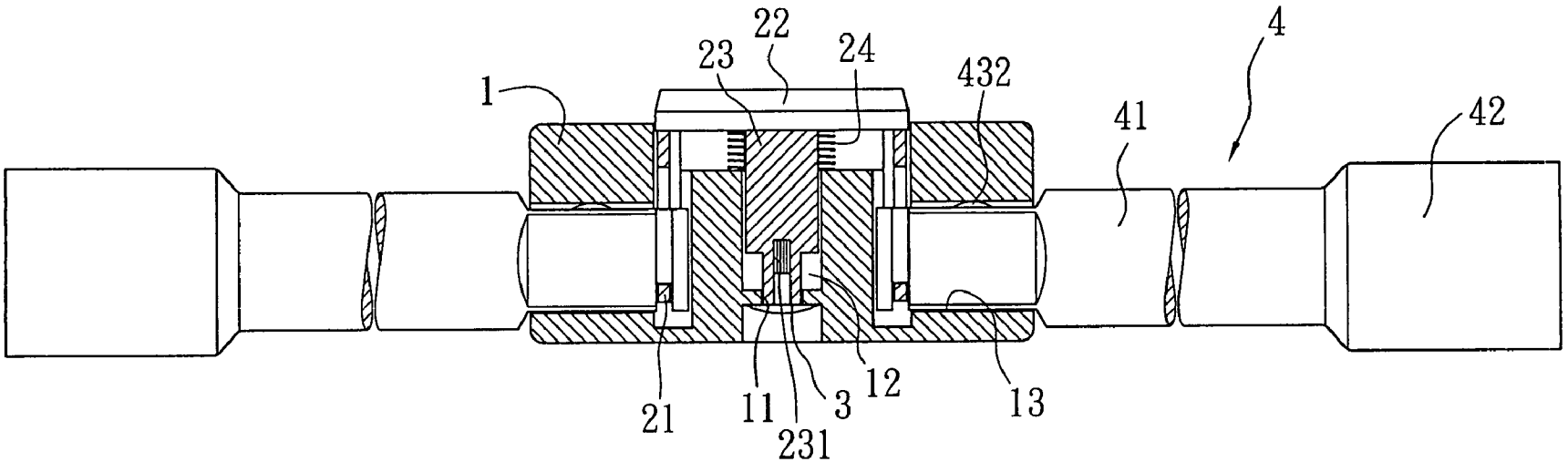
FIG. 2 is a sectional assembled view of the present invention.

The adjustment member 2 and the connector 1 are both integrally made without secondary processing. When assembled, the resilient member 24 is fitted around the shaft rod 23 of the adjustment member 2. Then, the adjustment member 2 is mounted in the receiving space 12 with the engaging section 21 of the adjustment member 2 aligned with the fixing tunnels 13. Accordingly, the fixing holes 211 and the fixing tunnels 13 communicate with each other. Then the rivet is passed through the bottom of the connector 1 into the shaft hole 231 to fix the adjustment member 2 with the connector 1. Then the rotary members 4 are respectively inserted into the fixing tunnels 13 with the fixing members 432 of the rotary members 4 abutting against inner walls of the fixing tunnels 13. Then the press button 22 is released, whereby by means of the restoring force of the resilient member 24, the engaging sections 21 are engaged in the engaging channels 431 as shown in FIG. 2. Accordingly, the present invention can be easily assembled to save time and labor as well as reduce manufacturing cost.

Figure 3:
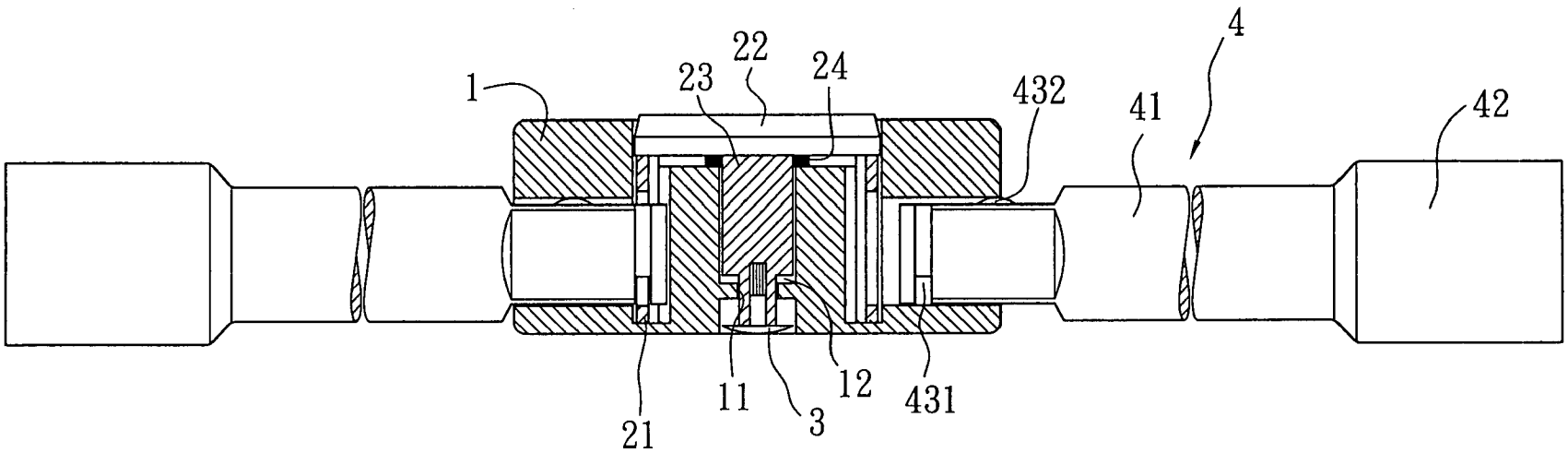
FIG. 3 is a sectional assembled view according to FIG. 2, showing the replacement of the rotary member.

Referring to FIG. 3, when replacing the rotary member 4, a user only needs to press down the press button 22. At this time, the fixing holes 211 and the fixing tunnels 13 communicate with each other, permitting the user to extract the rotary members 4 out. Then, the new rotary members 4 are inserted into the fixing tunnels 13 and the press button 22 is released. At this time, by means of the restoring force of the resilient member 4, the adjustment member 2 is restored to its home position where the engaging section 21 is engaged in the engaging channels 431 of the rotary members 4. Accordingly, the replacement of the rotary members 4 can be quickly completed.

According to the above arrangement, the present invention has the following advantages:

1. Time and labor are saved.
2. Manufacturing cost is reduced.
3. The operation is simplified.
4. The rotary members can be more quickly replaced.

Figure 4:
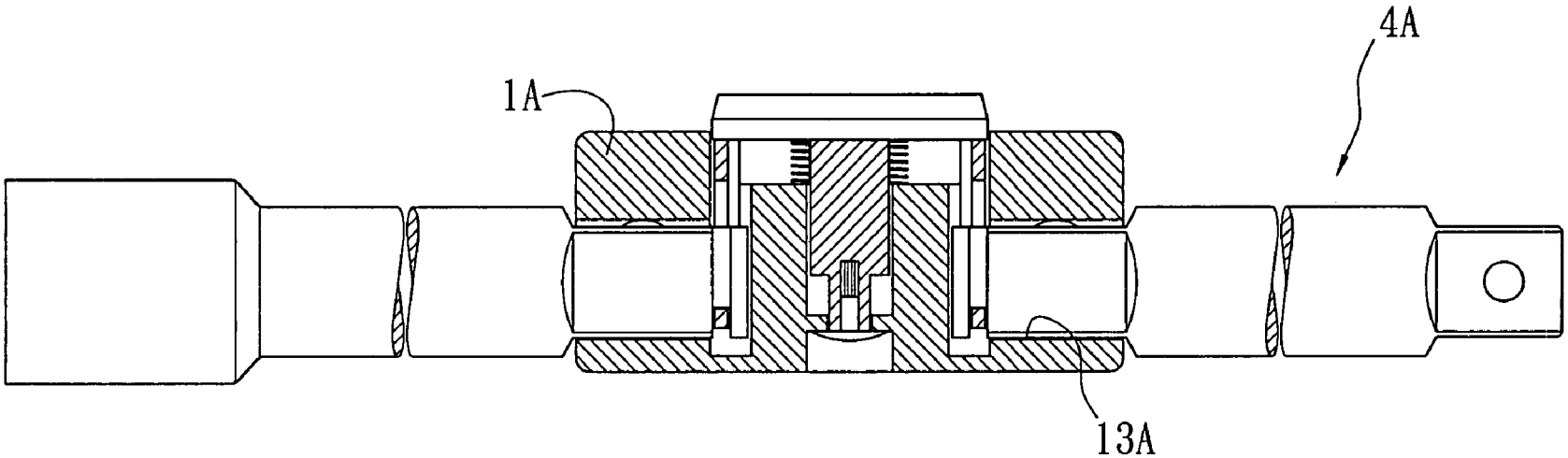
FIG. 4 is a sectional assembled view of a second embodiment of the present invention.
Figure 5:
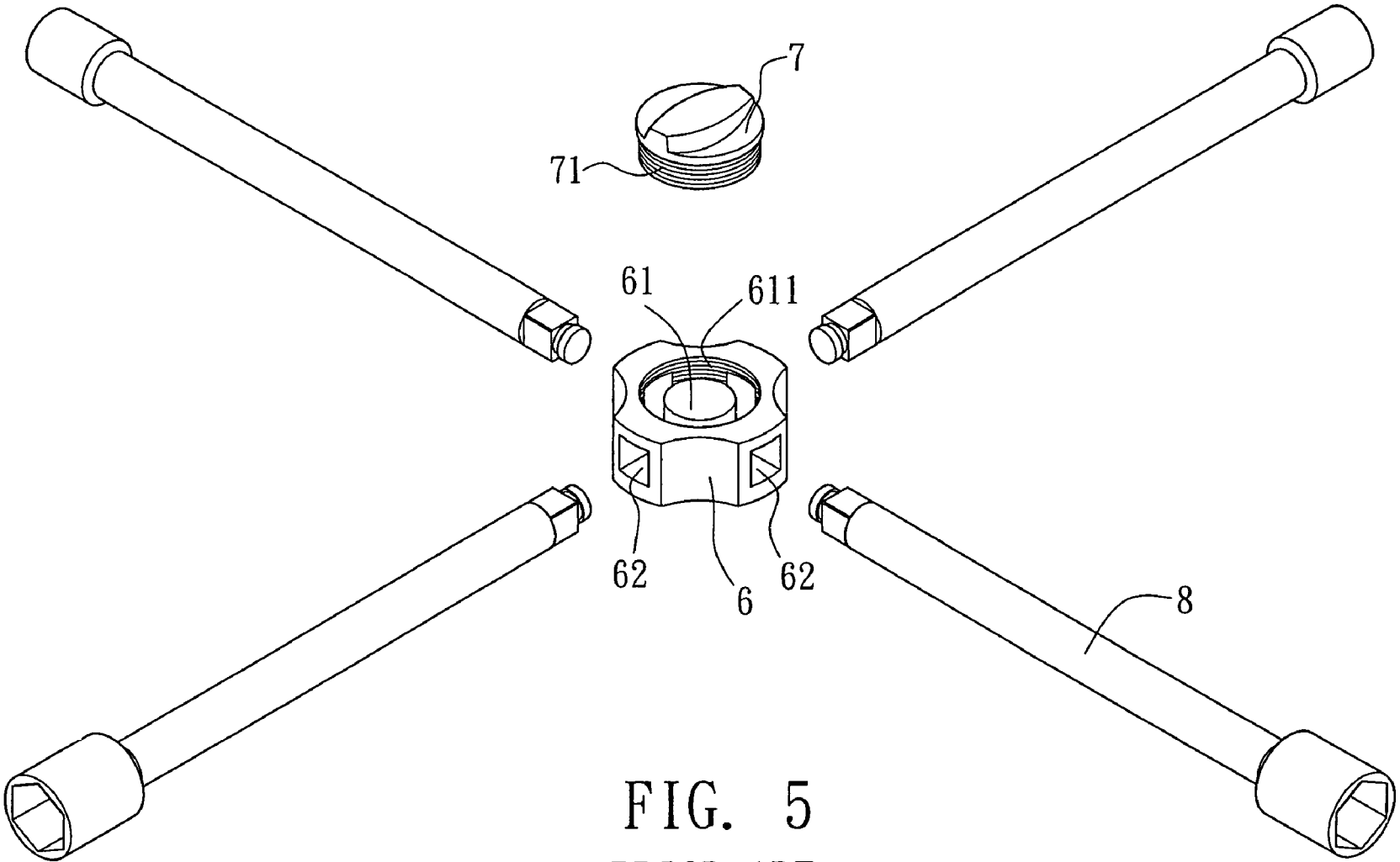
FIG. 5 PRIOR ART
FIG. 5 is a perspective exploded view of a conventional cross-type wrench.
Figure 6:
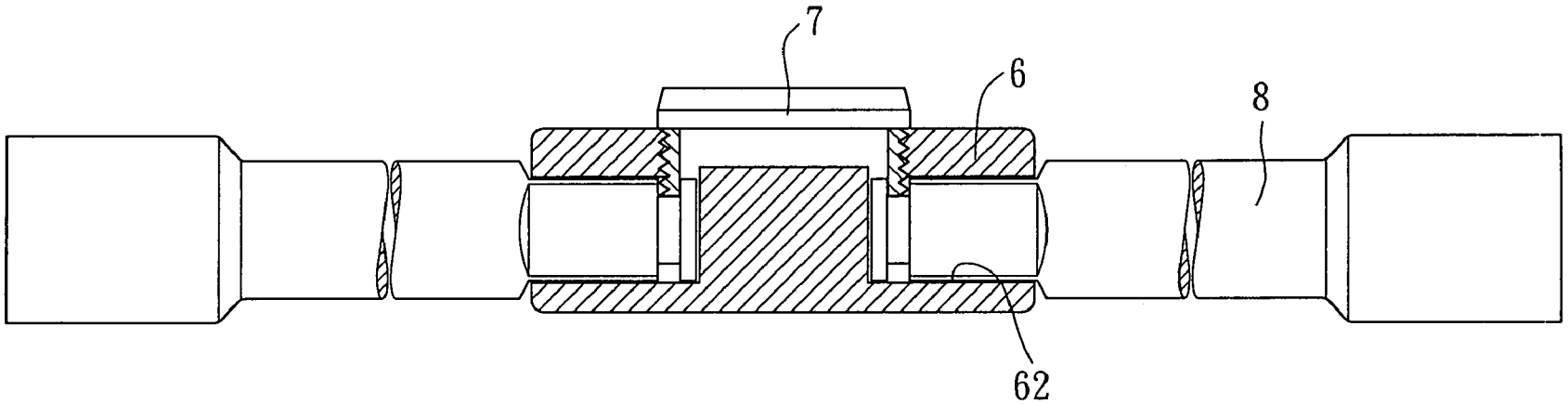
FIG. 6 PRIOR ART
FIG. 6 is a sectional assembled view of the conventional cross-type wrench.

FIG. 4 shows a second embodiment of the present invention, in which different types of rotary members 4A can be inserted into the fixing tunnels 13A of the connector 1A.

The above embodiments are only used to illustrate the present invention, not intended to limit the scope thereof. Many modifications of the above embodiments can be made without departing from the spirit of the present invention.

What is claimed is:

1. A cross-type wrench comprising a connector in which an axial receiving space is formed and an adjustment member accommodated in the receiving space, the connector being formed with several radial fixing tunnels for several rotary members to insert therein, whereby the rotary members can wrench a work piece, said cross-type wrench being characterized in that a dogging cavity and the receiving space are formed in the connector, in which the adjustment member is accommodated, the adjustment member having a downward extending engaging section formed with multiple fixing holes, a press button being disposed on a top end of the adjustment member, the press button being connected with a downward extending shaft rod formed with an axial shaft hole, a second fixing member being passed through a bottom end of the connector and inserted in the shaft hole, a resilient member being fitted around the shaft rod, an outer circumference of the connector being formed with multiple fixing tunnels for several rotary members to insert therein.

2. The cross-type wrench as claimed in claim 1, wherein the second fixing member is a rivet with an embossed top end fixed in the shaft hole of the shaft rod.

3. The cross-type wrench as claimed in claim 1, wherein the fixing tunnels extend from the outer circumference of the connector into the receiving space corresponding to the fixing holes, the engaging section of the adjustment member being inserted into the receiving space to inner ends of the fixing tunnels, the rotary members being laterally inserted through the fixing tunnels into the fixing holes of the engaging section of the adjustment member.

4. The cross-type wrench as claimed in claim 1, wherein each rotary member includes a handle section, a wrenching section and a fixing section, the fixing section having an engaging channel and a fixing member, whereby the engaging section of the adjustment member can be engaged in the engaging channel of the rotary member.

* * * * *